US008967587B1

(12) United States Patent
Timoshchuk

(10) Patent No.: US 8,967,587 B1
(45) Date of Patent: Mar. 3, 2015

(54) ARCUATE CONCRETE FORM AND SYSTEM FOR FORMING ARCUATE CONCRETE FLATWORK

(76) Inventor: Rostis N. Timoshchuk, Chattanooga, TN (US)

( * ) Notice: Subject to any disclaimer, the term of this patent is extended or adjusted under 35 U.S.C. 154(b) by 785 days.

(21) Appl. No.: 13/247,157

(22) Filed: Sep. 28, 2011

(51) Int. Cl.
*E01C 19/50* (2006.01)

(52) U.S. Cl.
CPC ..... *E01C 19/502* (2013.01)
USPC ..... 249/4; 249/6

(58) Field of Classification Search
CPC ..... E01C 19/502
USPC ..... 249/2, 3, 4, 5, 6, 7
See application file for complete search history.

(56) References Cited

U.S. PATENT DOCUMENTS 1,745,712 A * 2/1930 Rauber ..... 249/154
1,770,518 A * 7/1930 Harrold ..... 249/5
2,663,925 A * 12/1953 Yates ..... 249/6
2,843,912 A * 7/1958 Benson ..... 249/119
2,846,748 A * 8/1958 Owen et al. ..... 249/7
4,712,764 A * 12/1987 White ..... 249/6
4,750,703 A * 6/1988 Gentilcore et al. ..... 249/6
4,776,555 A * 10/1988 Maynard ..... 249/6
5,863,453 A * 1/1999 Hardin ..... 249/196
5,884,439 A * 3/1999 Hess et al. ..... 52/155
7,832,705 B2 * 11/2010 Spencer et al. ..... 249/219.1
7,950,872 B2 * 5/2011 Radu, Jr. ..... 404/7

OTHER PUBLICATIONS

Dee Concrete Accessories II, www.deeconcrete.com, Parts List 2009. No date listed.

* cited by examiner

*Primary Examiner* — Michael Safavi
(74) *Attorney, Agent, or Firm* — John B. Hardaway, III; Nexsen Pruet, LLC

(57) ABSTRACT

A fixed form suitable for use in framing concrete with arches is described as is an adjustable form and a system for forming concrete. The fixed form has an arch with a fixed radius terminating at arch ends. At least one frame element is attached to the arch wherein the frame element terminates at an arch end at a frame face and the frame face is perpendicular to a tangent of the arch at the arch end. The adjustable form has an adjustable radius.

3 Claims, 10 Drawing Sheets

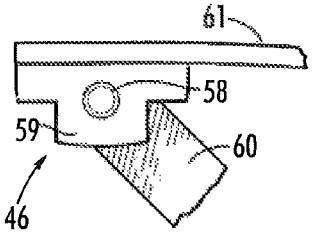
FIG. 13
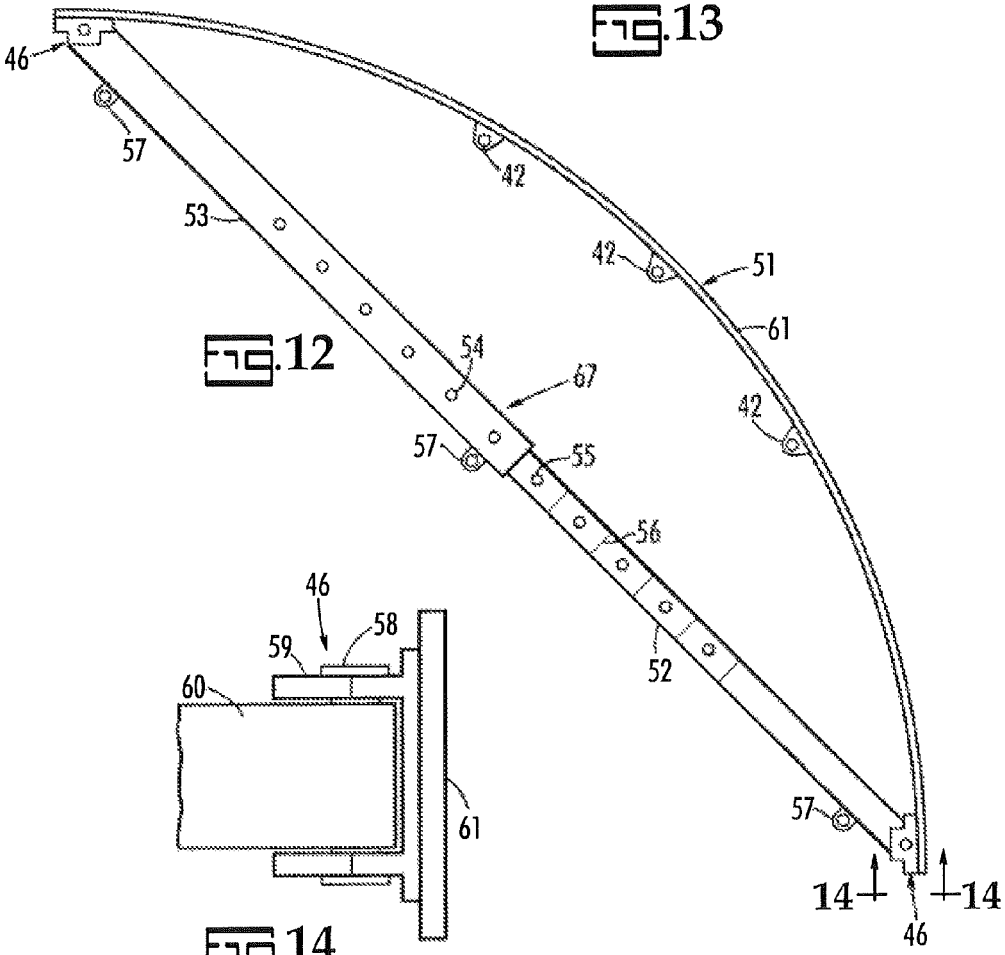
FIG. 12
FIG. 14

ARCUATE CONCRETE FORM AND SYSTEM FOR FORMING ARCUATE CONCRETE FLATWORK

BACKGROUND

The present invention is related to a form for accurately and efficiently forming arcuate sections of concrete and a system for forming arcuate concrete flatwork.

The art of creating flat concrete sections within a form is well known for such applications as sidewalks, driveways, patios and the like. In general, a form is constructed which matches the exterior shape and dimensions of the intended concrete shape wherein the form functions as a dam. Concrete, which is flowable, is poured into the area within the dam and the concrete is then manipulated until the area within the dam is filled thereby forming a concrete pad, after curing, with the same general edge shape as the constructed form.

Linear portions of flatwork concrete are easily formed using standard boards, such as a 2×4's, or by using straight steel forms both of which are commercially available and in widespread use. Forming an arch, or a radius, in concrete has always been a difficult and tedious process. Typically, a very thin material, such as a thin sheet of plywood, plastic or spring steel, is placed in position using stakes and the like. It is well known in the art that the creation of an aesthetically pleasing radius is labor intensive and even the most skilled artisans have great difficulty in achieving adequate results. Attempts to match radii or to form complementary radii is typically not attempted due to the labor intensive nature of the work.

Due to the foregoing difficulties the art of forming flatwork concrete has been restricted to relatively straight sections or very simple designs which avoid the necessity for radii or arched sections. There has been a long standing desire for a concrete form, and a system for forming concrete, which utilizes minimal labor, is easily constructed and which is reusable. The present application provides an advance in the art which was previously lacking.

SUMMARY

It is an object of the invention to provide forms, and a system, for forming arches, or arcuate shapes, in concrete flatwork.

A particular feature of the invention is the ability to create shapes easily and repeatedly and with complimentary or matching arches.

These and other advantages, as will be realized, are provided in a concrete form. The form has an arch with a fixed radius terminating at arch ends. At least one frame element is attached to the arch wherein the frame element terminates at an arch end at a frame face and the frame face is perpendicular to a tangent of the arch at the arch end.

Yet another embodiment is provided in a system for forming a concrete path with a width of W. The system includes a concave form comprising a concave arch with a radius of $R_1$ wherein the concave arch spans a portion of a circle with a radius $R_1$ and at least one first frame element attached to the concave arch wherein the frame first element terminates at a concave arch end at a first frame face and the first frame face is perpendicular to a first tangent of the concave arch at the first arch end. A convex form is provided comprising a convex arch with a radius of $R_2$ wherein the convex arch spans the portion of a circle with a radius $R_2$ and at least one second frame element is attached to the convex arch wherein the second frame element terminates at a convex arch end at a second frame face and the second frame face is perpendicular to a second tangent of the convex arch at the second arch end. For the two elements $R_2=R_1+W$.

Yet another embodiment is provided in a form with an adjustable arch. The form comprises a flexible arch terminating at arch ends separated by a distance. At least one frame element is attached to the flexible arch at a pivot wherein the frame element is adapted to alter the distance wherein the flexible arch has a radius which varies in proportion to said distance.

BRIEF DESCRIPTION OF FIGURES

FIG. 12 is a top schematic view of a concave embodiment of the invention with an adjustable flexible form.

FIG. 13 is an enlarged top schematic view of a portion of the FIG. 12 view.

FIG. 14 is a left side view of FIG. 13.

DETAILED DESCRIPTION

The present invention is related to a form for forming arcuate, or radiused, concrete flatwork and to a system for forming arcuate concrete flatwork.

The invention will be described with reference to the figures forming an integral, non-limiting, component of the specification. Throughout the description similar elements will be numbered accordingly.

Figure 1:
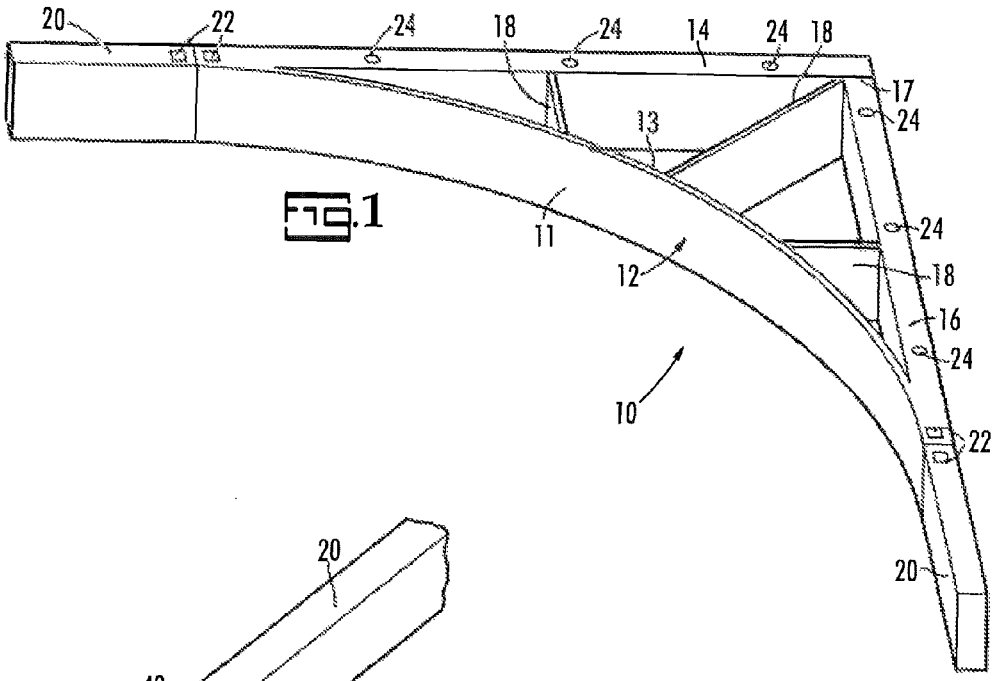
FIG. 1 is a perspective schematic view of a first embodiment of showing a convex form of the invention.

An embodiment of the invention is illustrated in perspective schematic view in FIG. 1 wherein depicted is a convex form, generally represented at 10, wherein the eventual concrete is rounded outward as on the exterior of a circle. A convex arch, 12, with a fixed radius of curvature, provides the dam which will form an exterior, convex, section of concrete. A particular advantage of the invention is that frame elements, 14 and 16, can be aligned with secondary form elements, 20, in a conventional manner. Each frame element is parallel to a tangent of the arch at the termination of the arch and the termination of the frame elements have a face which is perpendicular to the tangent of the arch at the termination of the arch as will be more fully understood from the description herein.

Braces, 18, between the back side, 13, of the convex arch and the frame elements are provided for structural integrity. The form surface, 11, of the convex arch is preferably a smooth material which is sufficiently rigid to insure the radius is maintained when concrete is poured there against. Linear secondary form elements are illustrated for simplicity in FIG. 1 without limit thereto. It would be apparent to one of skill in the art that the shape taken by the concrete would correspond to the inner shape of the secondary forms and convex form which is two straight sections meeting at a radius. The frame elements are perpendicular and may meet at a joint, 17. The type of joint is not particularly limiting but a rigid joint is most preferred for a fixed radius convex form. Mating locking elements, 22, on the frame elements and secondary form elements maintain the orientation during pouring and setting of the concrete. The locking elements insure that the frame elements and secondary form elements are aligned with minimal manipulation. The type of frame element is not particularly limiting herein. Bores, 24, may be provided in the frame elements to allow a rod to be driven into the ground, through the bore, to secure the convex form in position. Alternatively, stakes can be driven into the ground on the outside of the form. In another embodiment tabs may be provided on the back side of the frame element for receiving a stake there in.

Figure 2:
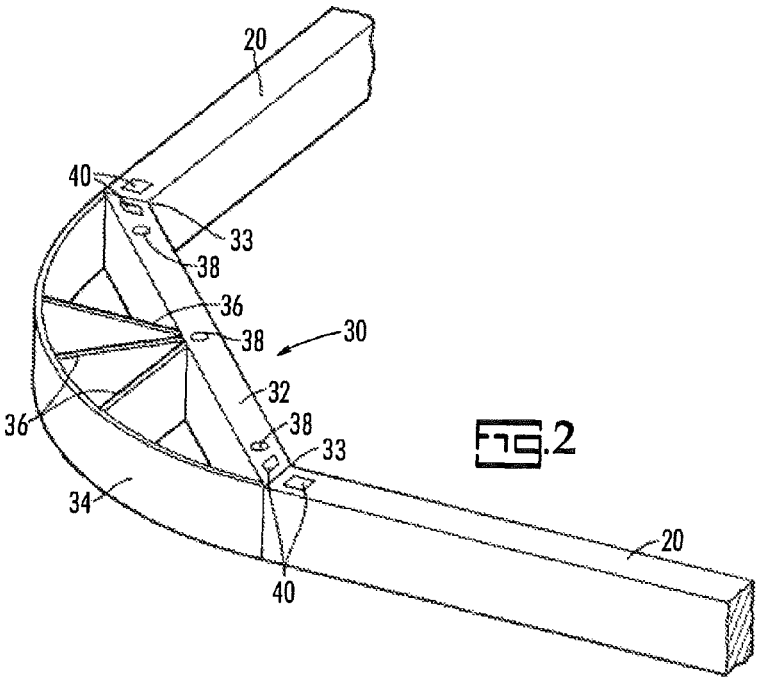
FIG. 2 is a perspective schematic view of a second embodiment of showing a concave form of the invention.

An embodiment of the invention is illustrated in perspective schematic view in FIG. 2 wherein depicted is a concave form, generally represented at 30, wherein the eventual concrete is rounded inward as on the interior of a circle. A concave arch, 34, with a fixed radius, is attached to a frame element, 32. The frame element preferably terminates at faces, 33, which are perpendicular to the tangent of the arch at the end of the arch as will be more fully appreciate in subsequent discussions. Mating locking elements, 40, are preferred to insure that the forms remain in the proper relative position. Bores, 38, are preferably provide to allow rods to be pushed there through into the ground beneath to secure the form in position. As would be realized, the configuration of FIG. 2 would provide two perpendicular straight portions of sidewalk meeting at a concave radius.

Figure 3:
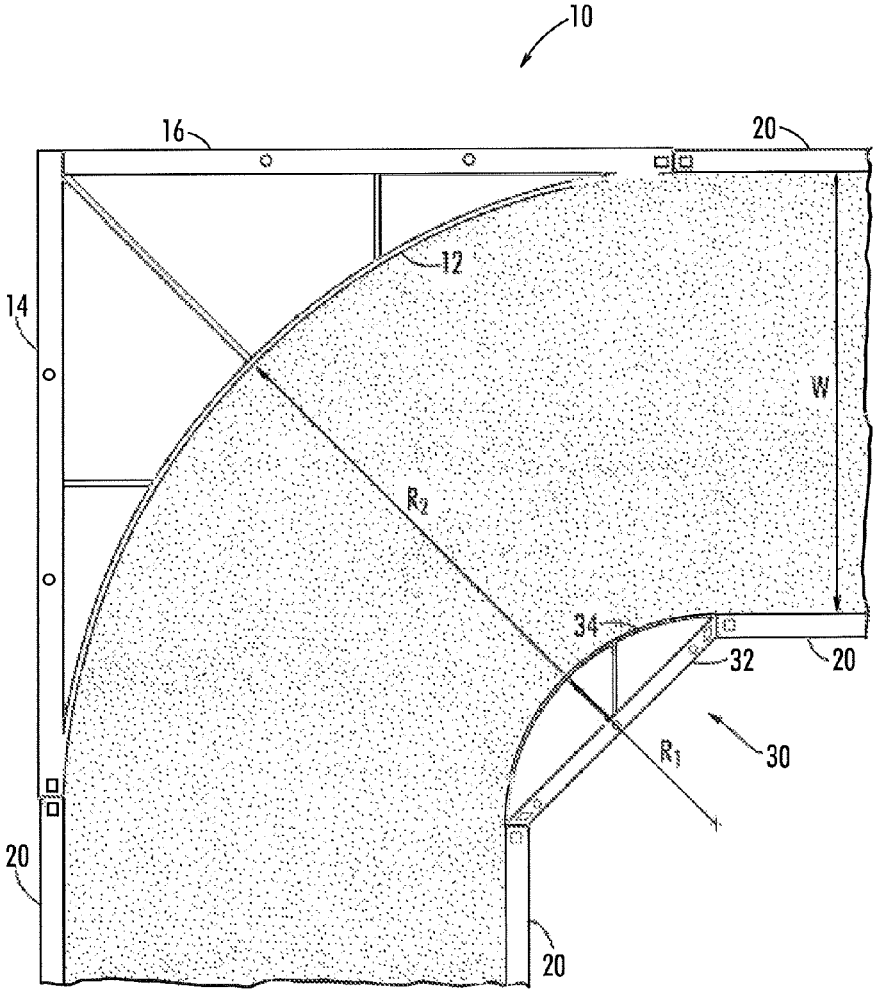
FIG. 3 is a top schematic view of an embodiment showing both convex and concave embodiment.

An embodiment of the invention is illustrated in top view in FIG. 3. In FIG. 3, a concrete strip with a constant width W would be created in accordance the invention. A convex form, 10, and a concave form, 30, are arranged with the arches parallel and a distance W apart. Secondary form elements, 20, are attached to the frame elements, 14 and 16, of the convex form and to the frame element, 32, of the concave form, 30. The radius of the concave portion of the concrete strip, corresponding to the concave arch, 34, has a radius of $R_1$. To create a strip with a common width the convex arch, 12, has a radius of $R_2$ wherein $R_2$ is the sum of $R_1$ and W. In FIG. 3 both the concave form and the convex form represent one fourth of a complete circle thereby providing a 90° rounded turn with a consistent width throughout. A particular feature of the invention is the ability to provide matched forms with each having a fixed radius for creating turns in a poured concrete strip.

Figure 4:
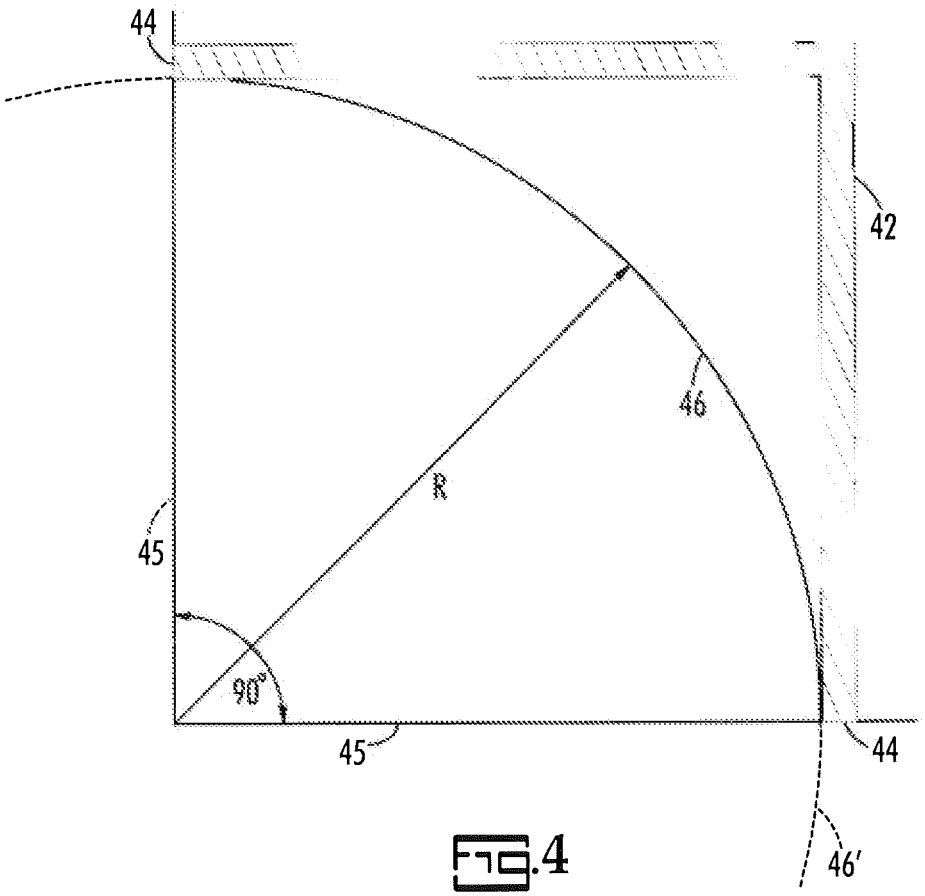
FIG. 4 is a top schematic view illustrating geometrical relationship of the convex embodiment.
Figure 5:
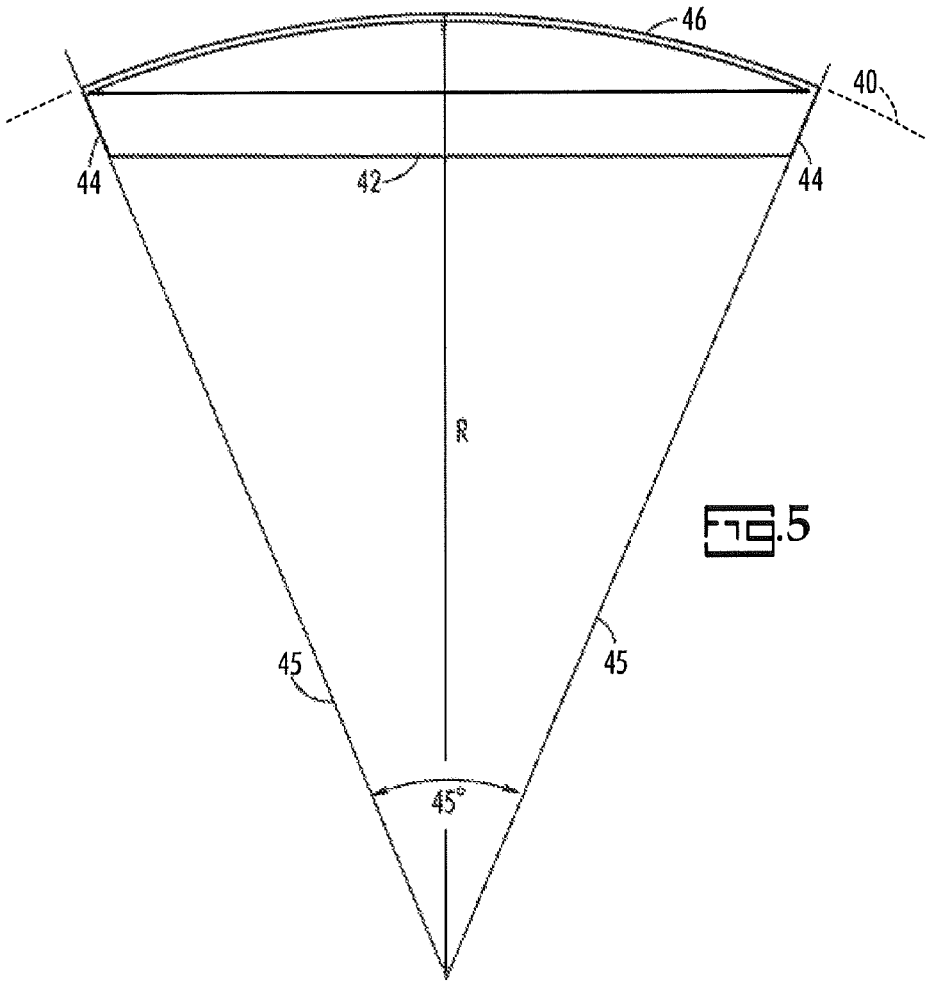
FIG. 5 is a top schematic view illustrating geometrical relationships of the concave embodiment.

An embodiment of the invention will be described with reference to FIGS. 4 and 5. FIG. 4 is a convex form with a radius R which spans one-fourth of a complete circle a portion of which is illustrated at 40. FIG. 5 is a concave form with a radius R which spans one-eighth of a complete circle a portion of which is illustrated at 40'. The convex form has a frame, 42, which is illustrated as forming a right angle for convenience. The frame has terminations, 44, each of which terminate parallel to the radius line containing the termination of the arch, 46. Similarly, the concave form has a frame, 42, illustrated as a single element, which has terminations, 44, each of which terminate parallel to the radius line, 44, containing the termination of the arch, 46. The frame terminations allow any form section adjacent the arched form to mate at a flat edge thereby creating a relatively seamless joint. A particular advantage offered thereby is the ability to utilize standard straight edges, squares, protractors and the like to align adjacent frames without regard for the intended curvature.

Figure 6:
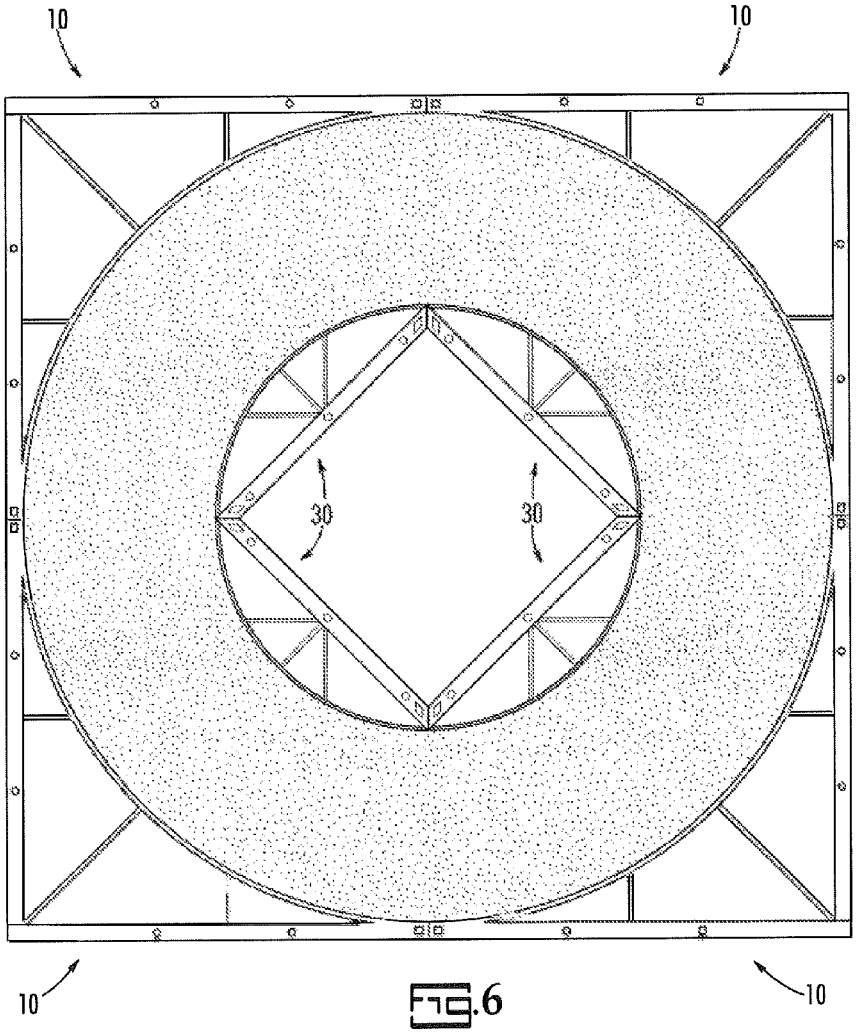
FIG. 6 is a top schematic view illustrating convex and concave combinations to form a circle.
Figure 7:
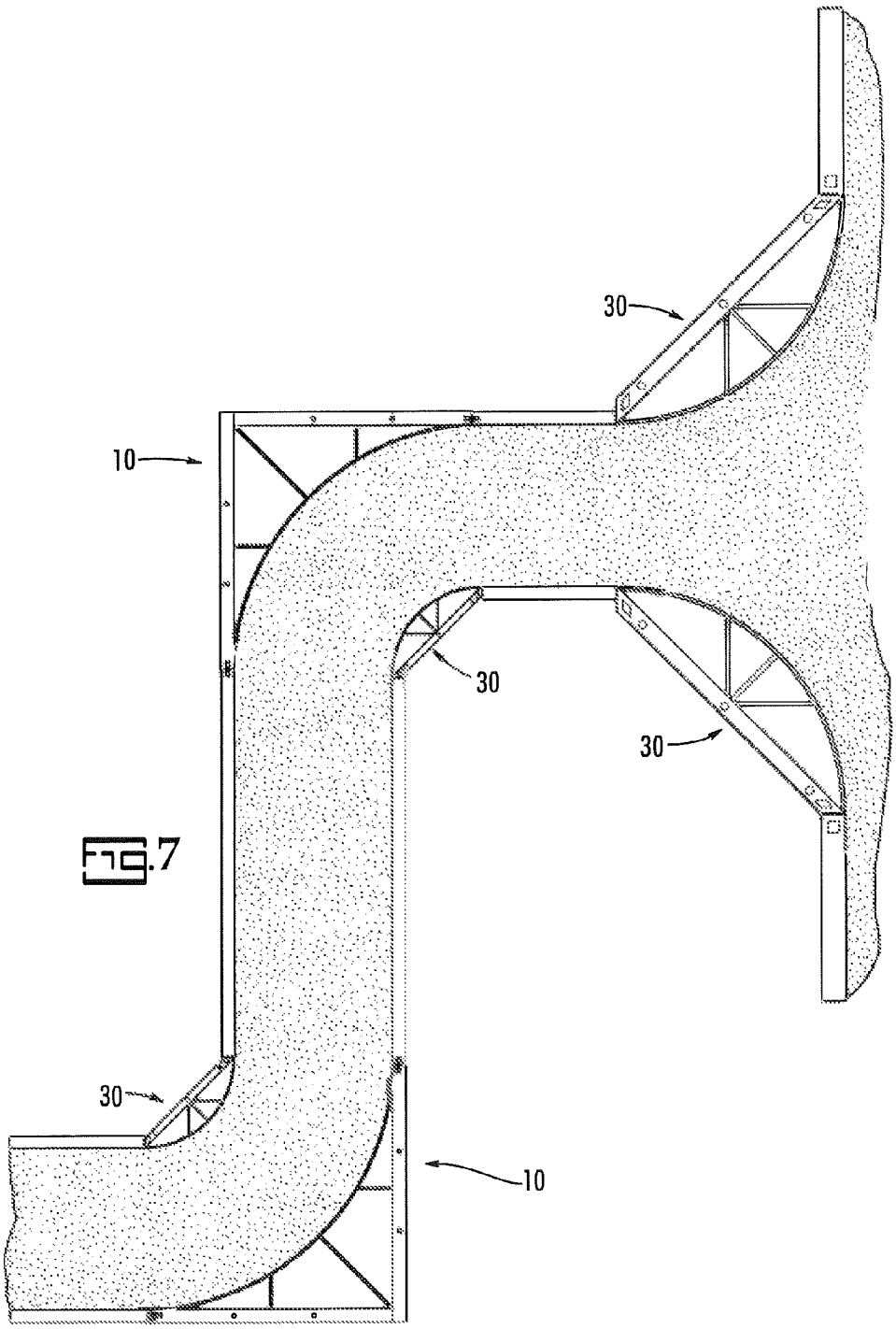
FIG. 7 is a top schematic view illustrating convex and concave embodiments to form a serpentine path.

Embodiments of the invention are illustrated in FIGS. 6 and 7 wherein multiple arches are taken together to form a ring in FIG. 6 and a serpentine path with a flair at a terminal end in FIG. 7.

Figure 8:
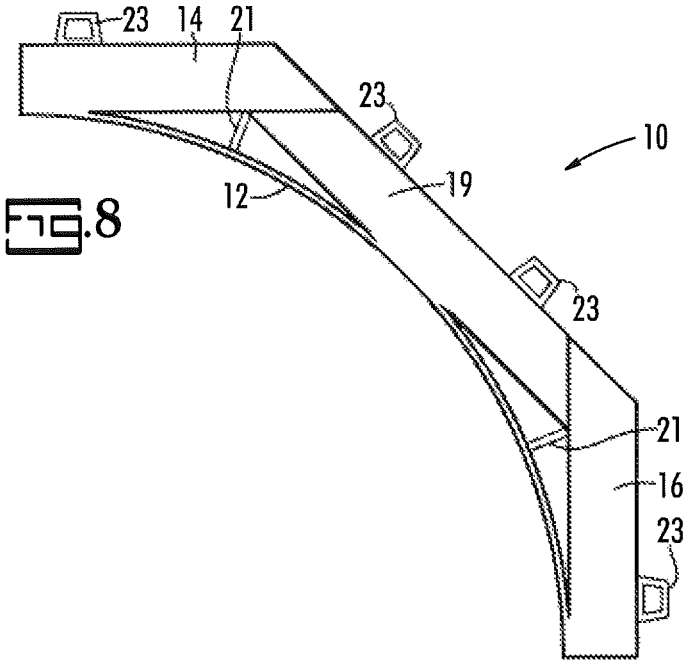
FIG. 8 is a top schematic view of another convex embodiment of the invention.

An embodiment of the invention is illustrated in FIG. 8 wherein a fixed convex form is illustrated in top schematic view. A brace, 19, spans between the frame elements, 14 and 16, thereby maintaining the convex arch, 12, in a position with a consistent radius. Additional braces, 21, may be employed. Tabs, 23, on the back of the form are adapted to receive a stake there through to pin the form in the desired location. Stakes are typically employed in form building with typical stakes being manufactured from wood, preferably with a triangular end, or rods, such as rebar.

Figure 9:
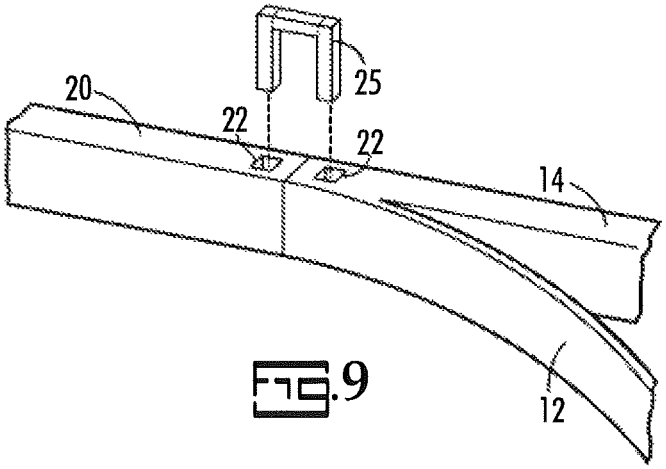
FIG. 9 is a top schematic view of yet another convex embodiment of the invention utilizing connectors.

An embodiment of a locking mechanism is illustrated schematically in FIG. 9. In FIG. 9 a connector, 25, is received by locking elements, 22, wherein the locking elements are bores. The connector may have diverging legs thereby pulling the forms together with increasing insertion depth.

Figure 10:
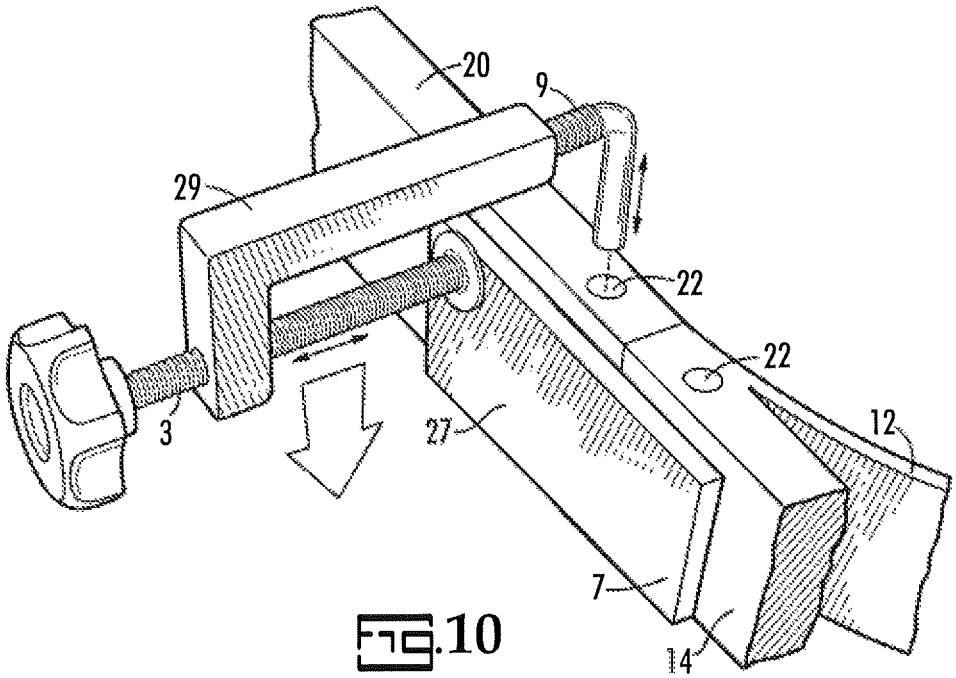
FIG. 10 is a top schematic view of embodiment illustrating another connector.

An embodiment of the locking mechanism is illustrated in exploded schematic top view FIG. 10. In FIG. 10, a U-clamp is illustrated as commercially available from www.rockler-.com, as item number 31373. The U-clamp connector has an L-pin, 9, with a rotationally adjustable length, which is inserted into a locking element, 22. A scab, 7, is preferably placed on the backside of the two frame elements and drawn into tight engagement by a threaded member, 3. A second U-clamp would be employed in the adjacent locking mechanism.

Figure 11:
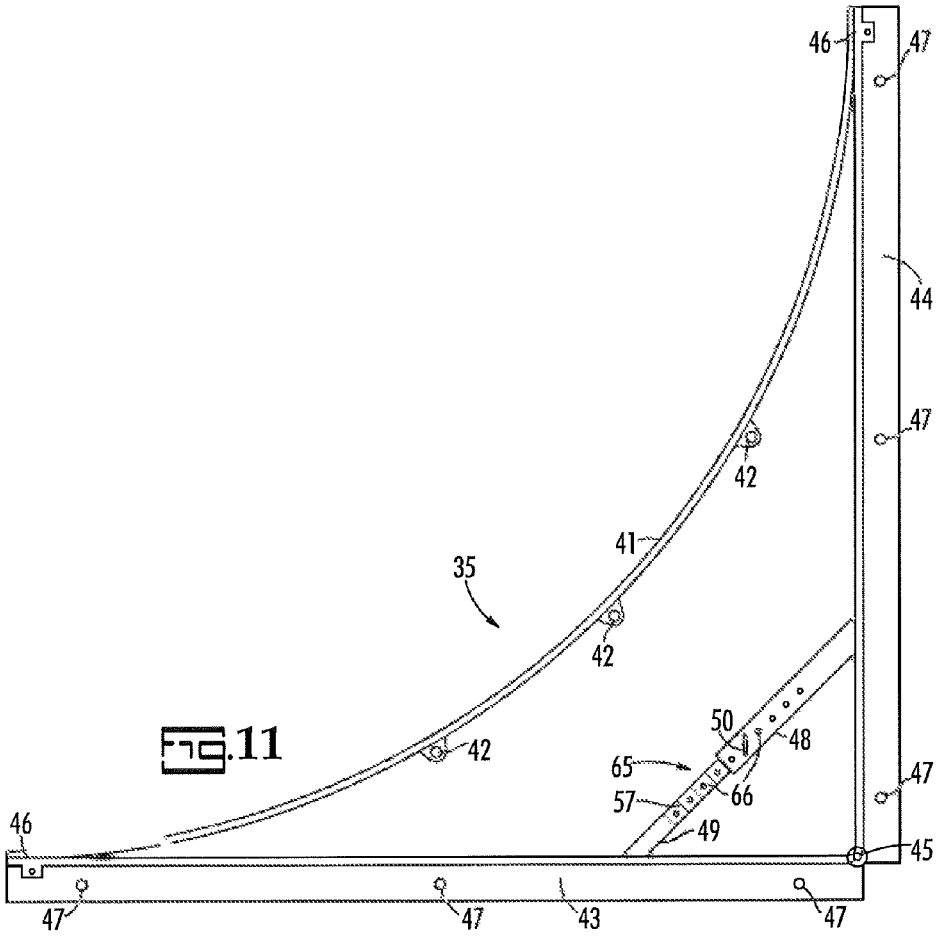
FIG. 11 is a top schematic view of a concave embodiment of the invention with an adjustable form.

An embodiment of the invention is illustrated in FIG. 11 wherein illustrated is an adjustable convex form generally represented at 35. The adjustable convex form has a flexible convex arch, 41. The flexible convex arch is pivotally attached by a pivot, 46, to frame elements, 43 and 44, which are pivotally attached at a hinge, 45. An optional, but preferred, adjustable brace, 65, between the frame elements, 43 and 44, allows the angle between the frame elements to be fixed at various locations. In a particularly preferred embodiment the adjustable brace has incremental, and reversible, positions which are achieved by matching voids, 66, in an outer sleeve, 48, and an inner sleeve, 49, which are secured in alignment by a pin, 50. Indicia, 67, on the adjustable brace are particularly desirable. The indicia indicate either the radius of the flexible convex arch, at the specific elongation of the flexible brace, or a combined length of the adjustable brace. The indicia allow for rapid setup without measurement and facilitate matching of related adjustable braces or matching with fixed braces. Voids, 47, in the frame elements allow the frame to be secured to the ground by driving a stake there through. Tabs, 42, on the flexible convex arch allow the position of the arch to be fixed after placement by driving a stake, or rod, through the tab. In the embodiment illustrated in FIG. 11 the frame elements are represented as "L-shaped" frame elements. Particularly preferred frame elements are angled steel or angled aluminum due to the strength provided thereby. The voids, 47, can be in the part of the "L-shaped" frame element which is parallel to the ground.

An embodiment of the invention is illustrated in FIG. 12 wherein illustrated is an adjustable concave form generally represented at 51. The adjustable concave form comprises a flexible concave arch, 61. The flexible concave arch is pivotally attached by a pivot, 46, to an adjustable cross brace, 67. In a preferred embodiment the adjustable cross brace comprises an outer sleeve, 53, and an inner sleeve, 52, with mating voids, 54 and 55, which can be aligned to receive a pin, not shown. Indicia, 56, on the adjustable brace are particularly desirable. The indicia indicate either the radius of the flexible concave arch, at the specific elongation of the flexible brace, or a combined length of the adjustable brace. The indicia allow for rapid setup without measurement and facilitate matching of related adjustable braces or matching with fixed braces. Tabs, 57, in the adjustable brace and tabs, 42, in the flexible concave arch allow the adjustable concave form to be fixed by stakes, or rods, being driven there through.

A detailed view of a representative pivot, 46, is illustrated in schematic top view in FIG. 13 and in schematic side view in FIG. 14. An adjustable brace, 60, is attached at an axle, 58, which is received in a bracket, 59. The bracket is attached to the arch, 61. The pivot could be reversed if desired and other pivots could be employed.

The convex or concave arch can be made from any material which is compatible with concrete forms. Wood is acceptable with steel or aluminum being preferable due to the inertness provided thereby and the ease with which a radius can be formed. The forms can be made from any material with sufficient stiffness with wood being acceptable and steel or aluminum being preferred. The height of the convex and concave arch are preferably the same as the intended thickness of the concrete to be formed. It is most common to form a concrete pad four inches thick which would be most suitably done with a four inch high arch. It is most preferable that the top surface of the arch be parallel with the concrete pad since the top of the arch most preferably acts as a surface for concrete smoothing tools.

The convex and concave forms are each designed to be suitable for multiple applications. In one preferred embodiment, the convex and concave forms represent either a fixed one eighth of a circle or a fixed one fourth of a circle. A form which is a fixed one-eighth of a circle allows for a 45° turn or two taken together can form a 90° turn. A form which represent one fourth of a circle can be used for a 90° turn or two taken together can be used for a reverse in direction. Other dimensions are suitable yet one eighth and one fourth represent the majority of desired turns in a concrete pad.

Though not limited thereto, concrete pads are most commonly used for sidewalks and driveways. Sidewalks are typically about 2 ft-4 ft in width and drive ways are typically about 9 ft-11 ft in width. It is preferably to provide a system with the following combinations:

a) a quarter circle concave and quarter circle convex form with a radius difference of between 2 ft and 4 ft;

b) a quarter circle concave and quarter circle convex form with a radius difference of between 9 ft and 11 ft;

c) an eighth circle concave and eighth circle convex form with a radius difference of between 2 ft and 4 ft; and d) a eighth circle concave and eighth circle convex form with a radius difference of between 9 ft and 11 ft.

Such a system would provide a large range of flexibility with a reasonable number of components.

The forms are particularly suitable for forming concrete. Other applications are envisioned such as laying out and marking elements of construction wherein a specific radius is desired. In particular, trim elements, wall elements, stair case elements and the like and be marked and/or formed using the forms of the instant invention.

For the purposes of creating the form the artisan can utilize straight alignment techniques such that the secondary form element and frame elements are aligned without concern for the radius since it will be defined by the position of the frame elements.

The invention claimed is:

1. A concrete form comprising:

an arch with a fixed radius terminating at arch ends; and two frame elements attached to said arch ends wherein each of said frame elements terminates at one of said arch ends; said frame elements having a face and said frame face is perpendicular to a tangent of said arch at said arch ends and wherein said two frame elements meet said arch ends at a joint.

2. The concrete form of claim 1 wherein said arch is selected from a concave arch and a convex arch.

3. The concrete form of claim 1 further comprising braces between said arch and one of said frame elements.

* * * * *